US010516233B2

(12) United States Patent
Church-Diciccio et al.

(10) Patent No.: US 10,516,233 B2
(45) Date of Patent: Dec. 24, 2019

(54) CONFIGURABLE STRAIN RELIEVE PLATE

(71) Applicant: Virginia Panel Corporation, Waynesboro, VA (US)

(72) Inventors: Christopher Church-Diciccio, Waynesboro, VA (US); Randall Herron, Waynesboro, VA (US)

(73) Assignee: Virginia Panel Corporation, Waynesboro, VA (US)

( * ) Notice: Subject to any disclaimer, the term of this patent is extended or adjusted under 35 U.S.C. 154(b) by 0 days.

(21) Appl. No.: 15/976,335

(22) Filed: May 10, 2018

(65) Prior Publication Data

US 2018/0331466 A1 Nov. 15, 2018

Related U.S. Application Data

(60) Provisional application No. 62/504,311, filed on May 10, 2017.

(51) Int. Cl.
*H01R 13/58* (2006.01)

(52) U.S. Cl.
CPC ..... *H01R 13/5812* (2013.01)

(58) Field of Classification Search
CPC ..... H01R 13/5812
USPC ..... 439/470, 471, 472, 473, 719
See application file for complete search history.

(56) References Cited

U.S. PATENT DOCUMENTS 4,080,035 A * 3/1978 Clark ..... H01R 13/5804 24/16 PB
6,312,278 B1 * 11/2001 Prior ..... H01R 13/5833 206/320
6,419,519 B1 * 7/2002 Young ..... H01R 13/5812 439/446
6,447,327 B2 * 9/2002 Shimogama ..... H01R 13/56 439/470
6,679,722 B1 * 1/2004 Pulizzi ..... H01R 13/562 439/451
7,070,454 B1 * 7/2006 Pepe ..... H01R 13/6392 439/464
7,210,964 B2 * 5/2007 Morris ..... H01R 9/032 439/471
7,442,071 B2 * 10/2008 Bigotto ..... H01R 13/5812 439/470
7,915,542 B2 * 3/2011 Forbis ..... H02G 3/32 174/101
7,973,242 B2 * 7/2011 Jones ..... H04Q 1/06 174/100
8,025,525 B2 * 9/2011 Krueger ..... H01R 13/5812 439/446

(Continued)

*Primary Examiner* — Abdullah A Riyami
*Assistant Examiner* — Nelson R. Burgos-Guntin
(74) *Attorney, Agent, or Firm* — 24IP Law Group USA, PLLC; Timothy Dewitt

(57) ABSTRACT

A configurable strain relief plate assembly having a bracket member having a pair of arms and a support member between the two arms. The support member has a plurality of holes for connecting a plurality of tie down plates. The assembly has one or more captive screws or other means for connecting the bracket member to an interface module. The assembly further has one or more tie down plates connected to the support member, for example, with screws. Each tie down plate has one or more holes for connecting wires or contacts to the tie down plate, for example, with one or more zip ties or clips.

7 Claims, 9 Drawing Sheets

(56) References Cited

U.S. PATENT DOCUMENTS

| | | | | |
|---|---|---|---|---|
| 2003/0199193 | A1* | 10/2003 | Amemiya | H01R 13/5812<br>439/470 |
| 2005/0020124 | A1* | 1/2005 | Nad | H01R 13/5808<br>439/470 |
| 2005/0106948 | A1* | 5/2005 | Peng | H02G 3/32<br>439/719 |
| 2010/0136820 | A1* | 6/2010 | Muncy | H01R 13/5812<br>439/371 |
| 2011/0021064 | A1* | 1/2011 | Shibata | H01R 13/5213<br>439/470 |
| 2011/0237117 | A1* | 9/2011 | Lim | H01R 13/5812<br>439/470 |
| 2013/0196532 | A1* | 8/2013 | Utz | H01R 13/5812<br>439/471 |
| 2018/0331466 | A1* | 11/2018 | Church-Diciccio | H01R 13/5812 |

* cited by examiner

CONFIGURABLE STRAIN RELIEVE PLATE

CROSS-REFERENCE TO RELATED APPLICATIONS

The present application claims the benefit of the filing date of U.S. Provisional Patent Application Ser. No. 62/504,311 filed by the present inventors on May 10, 2017.

The aforementioned provisional patent application is hereby incorporated by reference in its entirety.

STATEMENT REGARDING FEDERALLY SPONSORED RESEARCH OR DEVELOPMENT

None.

BACKGROUND OF THE INVENTION

Field of the Invention

The present invention relates to strain relief plates for interface devices. More particularly, the invention relates to a configurable strain relief plate assembly for pins and wires in interface devices.

Brief Description of the Related Art

An exemplary conventional strain relief plate for use in an interface device is shown in FIGS. 1A and 1B. The conventional strain relief plate has a unitary structure having a body with a plurality of holes that can be used to strap or clip wires to the strain relief plate. The conventional strain relief plate has two captive screws for connecting the strain relief plate to an interface module.

SUMMARY OF THE INVENTION

In a preferred embodiment, the present invention is configurable strain relief plate assembly. The assembly has a bracket member having a pair of arms and a support member between the two arms. The support member has a plurality of holes for connecting a plurality of tie down plates. The assembly has one or more captive screws or other means for connecting the bracket member to an interface module. The assembly further has one or more tie down plates connected to the support member, for example, with screws. Each tie down plate has one or more holes for connecting wires or contacts to the tie down plate, for example, with one or more zip ties or clips.

In another preferred embodiment, the present invention is a configurable strain relief plate assembly having a bracket member and a plurality of tie down plates removably connected to the bracket member. The bracket member has a support member configured to allow for connection of a plurality of tie down plates to the support member and has a plurality of mounting members extending from the support member, each the mounting member having a distal end portion configured to connect the mounting member to an interface module. The plurality of tie down plates connected to the support member of the bracket member. Each tie down plate has a first end configured to connect to the support member of the bracket member and a second portion configured to receive a plurality of connectors for connecting wires or cables to the tie down plate. Each of the plurality of mounting members may have a flange at a distal end and a hole in the flange for connecting the mounting member to an interface module with a screw. Further, each of the plurality of tie down plates may be removably connected to the support member with at least one screw.

Still other aspects, features, and advantages of the present invention are readily apparent from the following detailed description, simply by illustrating a preferable embodiments and implementations. The present invention is also capable of other and different embodiments and its several details can be modified in various obvious respects, all without departing from the spirit and scope of the present invention. Accordingly, the drawings and descriptions are to be regarded as illustrative in nature, and not as restrictive. Additional objects and advantages of the invention will be set forth in part in the description which follows and in part will be obvious from the description, or may be learned by practice of the invention.

BRIEF DESCRIPTION OF THE DRAWINGS

For a more complete understanding of the present invention and the advantages thereof, reference is now made to the following description and the accompanying drawings, in which.

DETAILED DESCRIPTION OF THE PREFERRED EMBODIMENTS

Figure 1A:
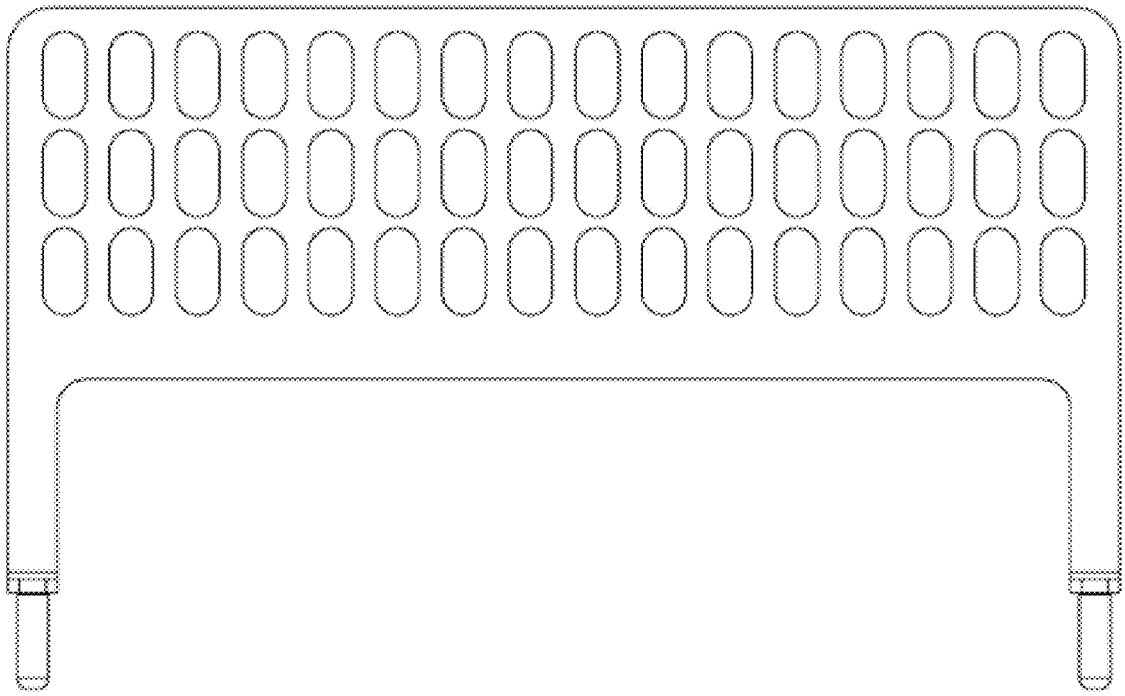
FIG. 1A PRIOR ART
FIG. 1A is a front view of a conventional strain relief plate for an interface device.
Figure 1B:
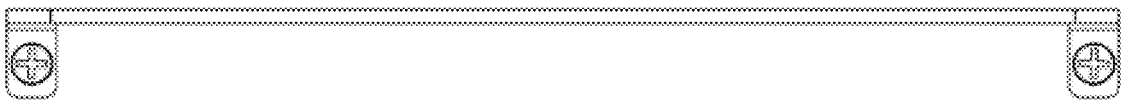
FIG. 1B PRIOR ART
FIG. 1B is a top view of a conventional strain relief plate for an interface device.
Figure 2A:
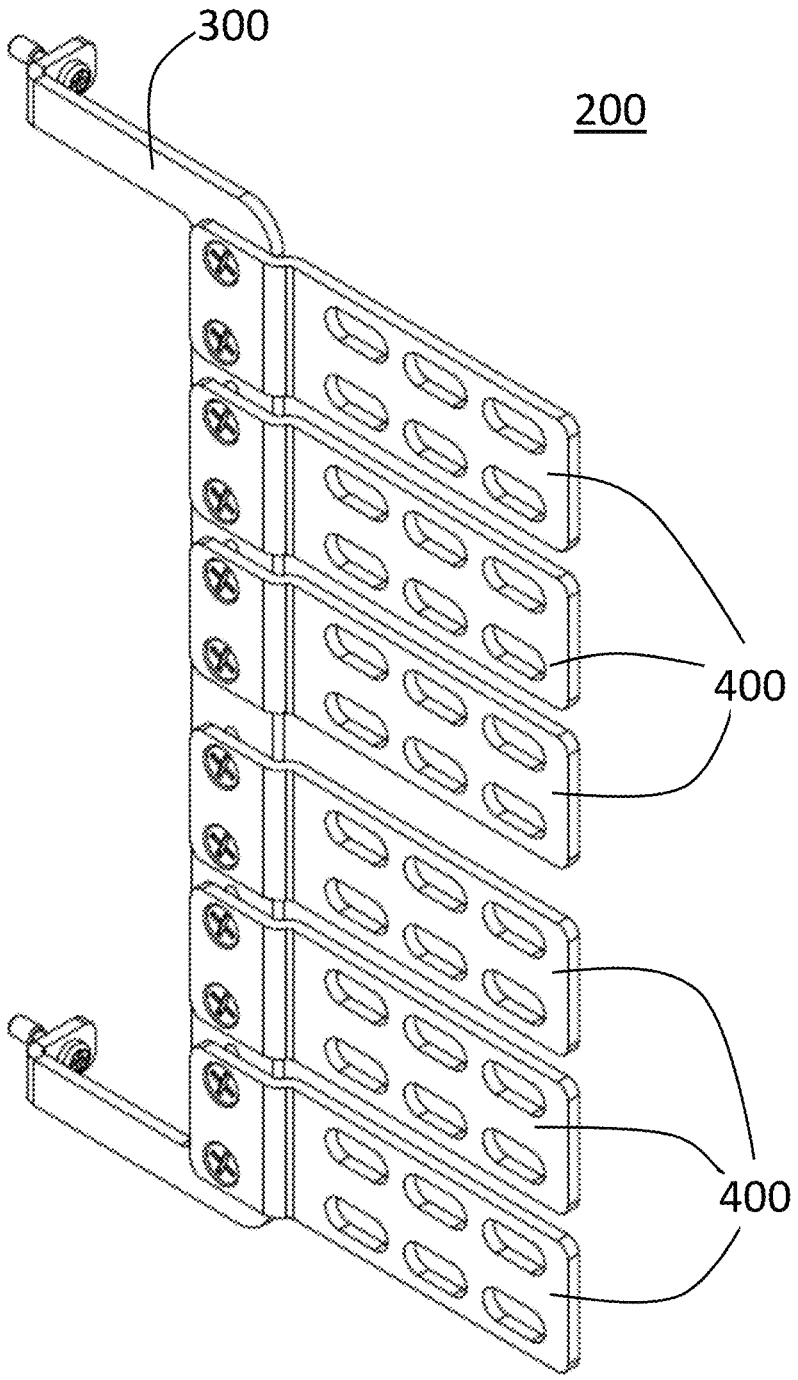
FIG. 2A is a perspective view of a preferred embodiment of a strain relief plate assembly in accordance with a preferred embodiment of the present invention.
Figure 2B:
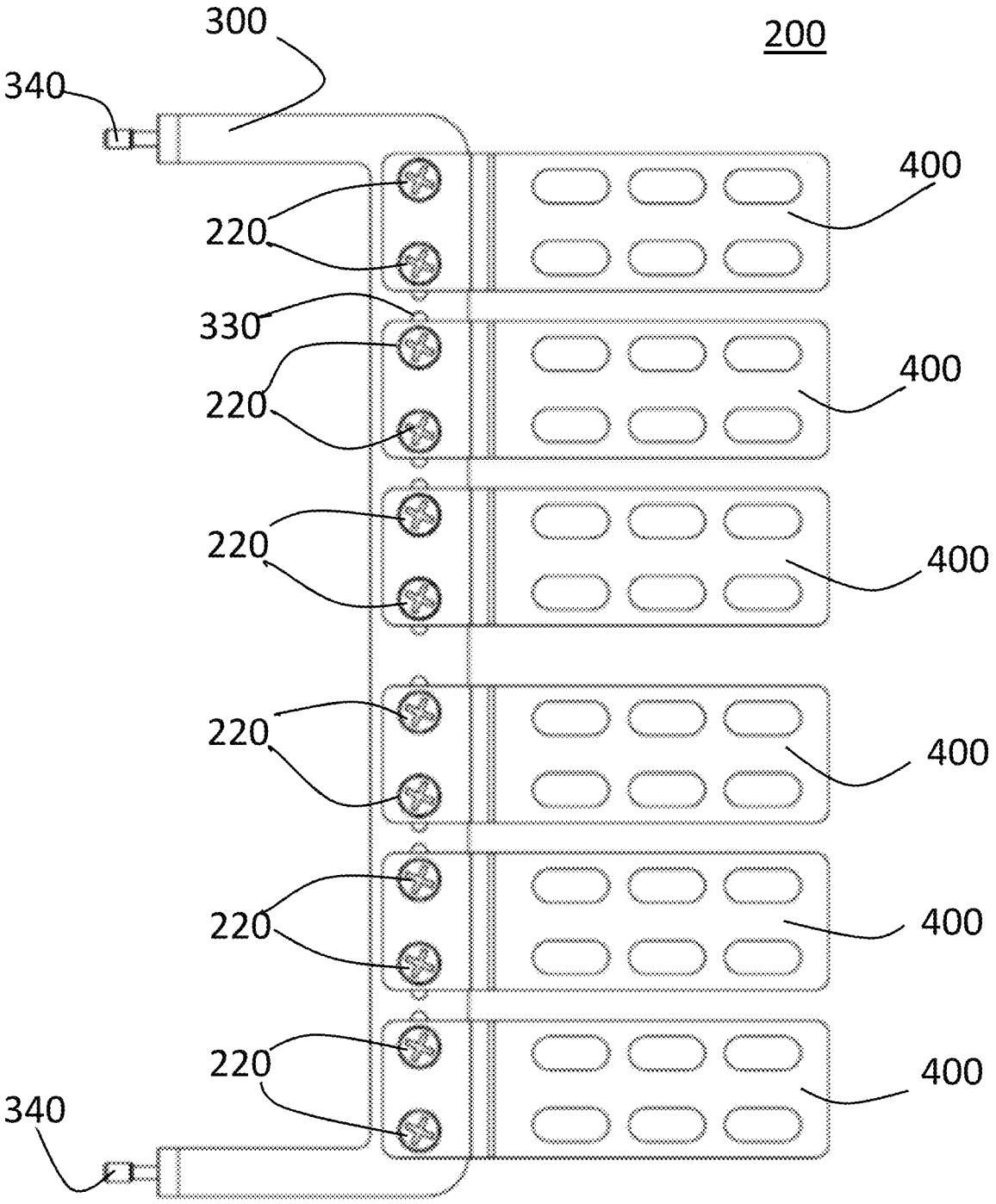
FIG. 2B is a front view of a preferred embodiment of a strain relief plate assembly in accordance with a preferred embodiment of the present invention.
Figure 2C:
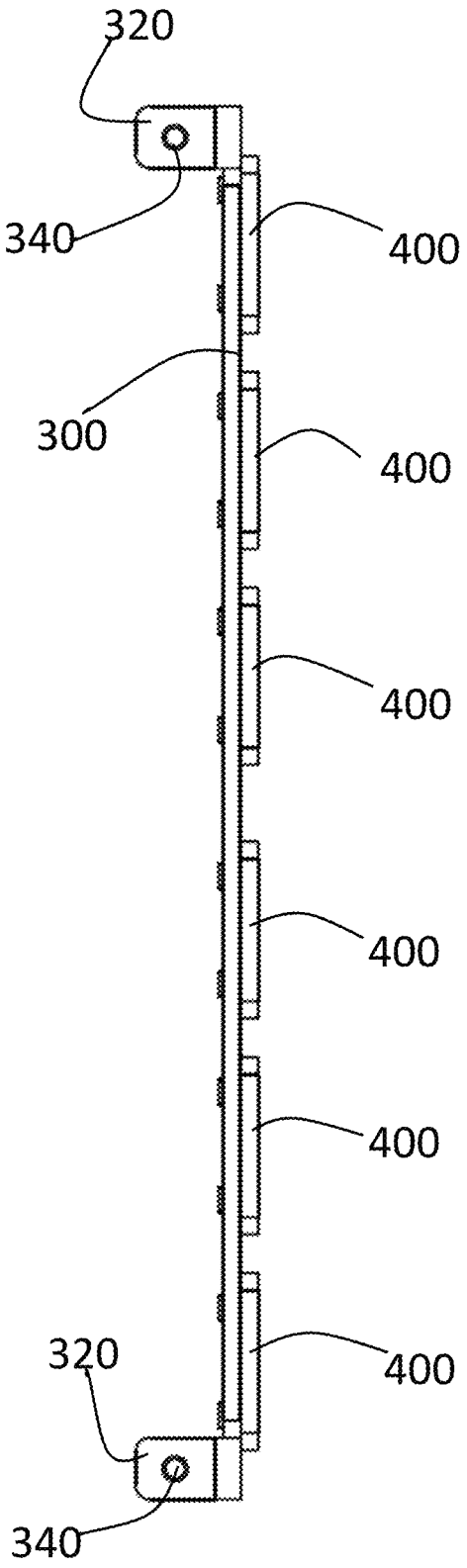
FIG. 2C is a bottom view of a preferred embodiment of a strain relief plate assembly in accordance with a preferred embodiment of the present invention.
Figure 2D:
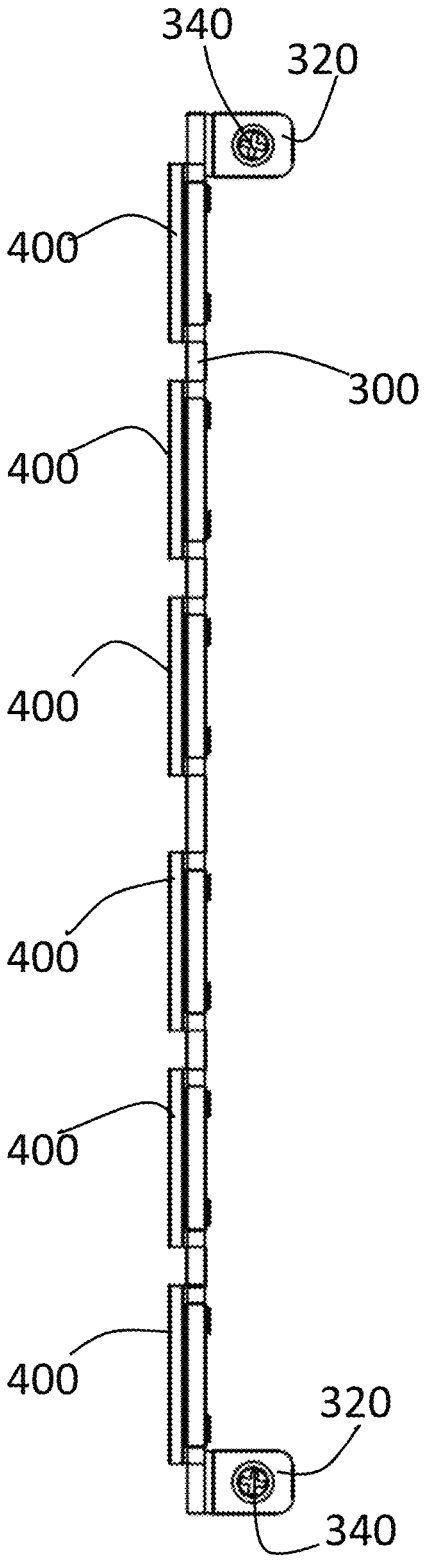
FIG. 2D is a top view of a preferred embodiment of a strain relief plate assembly in accordance with a preferred embodiment of the present invention.
Figure 3A:
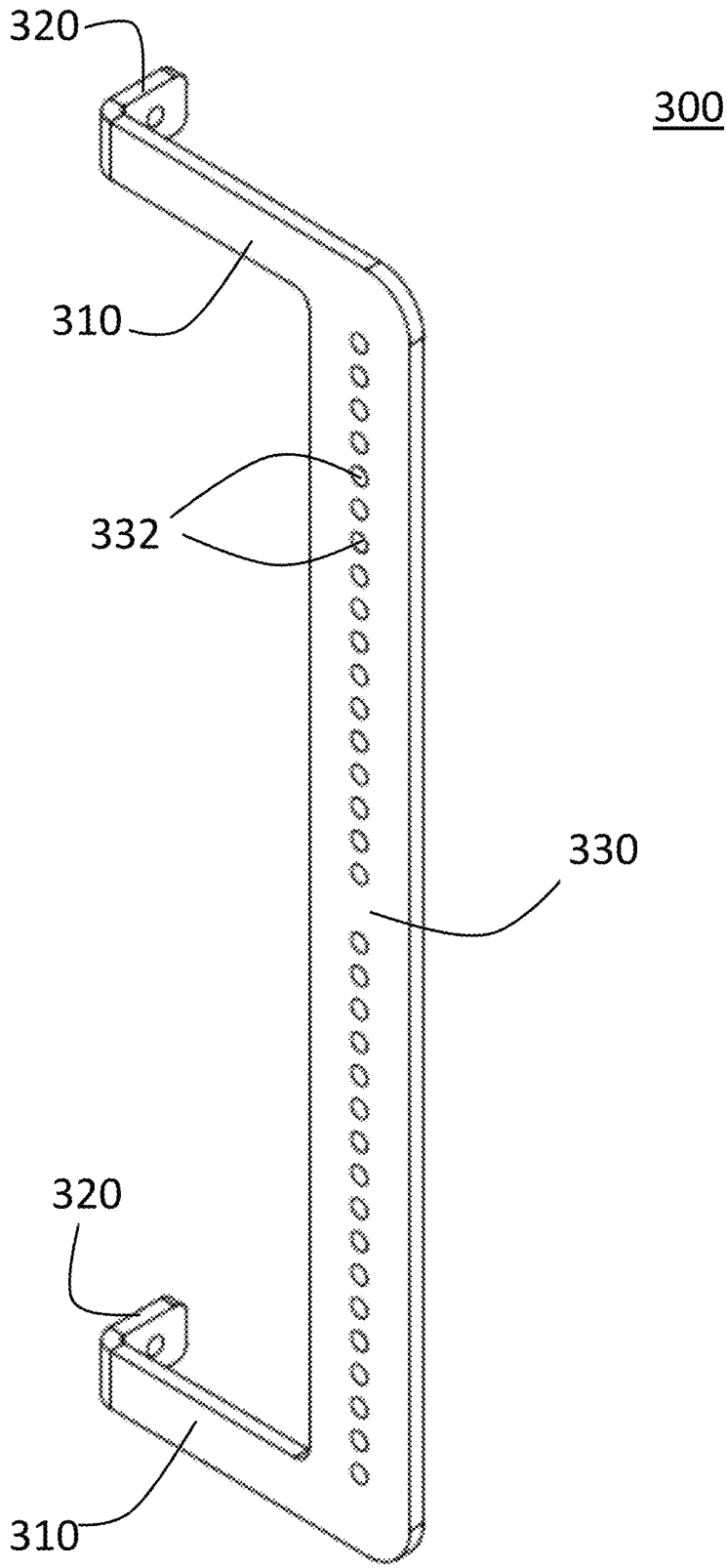
FIG. 3A is a perspective view of a preferred embodiment of a bracket member of strain relief plate assembly in accordance with a preferred embodiment of the present invention.
Figure 3D:
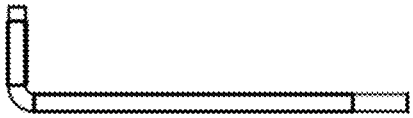
FIG. 3D is a side view of a preferred embodiment of a bracket member of strain relief plate assembly in accordance with a preferred embodiment of the present invention.
Figure 3B:
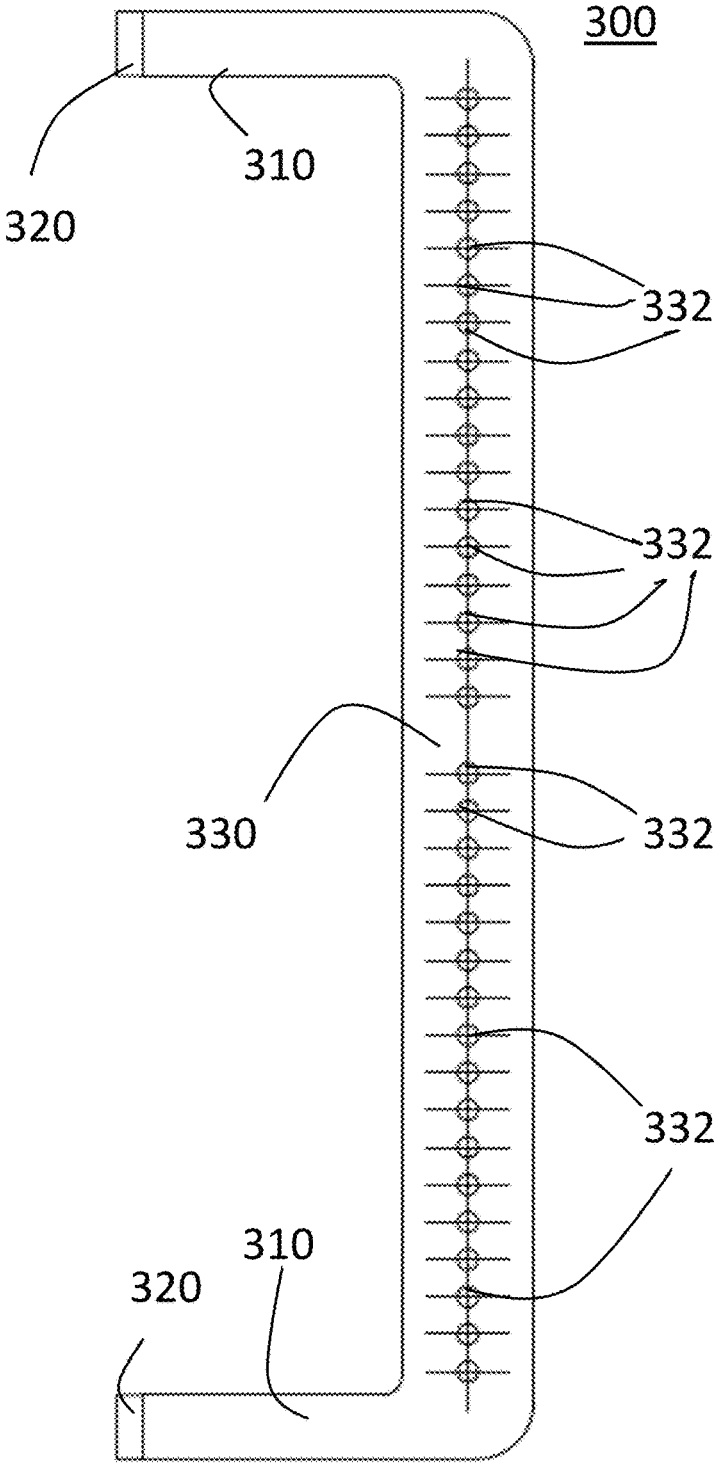
FIG. 3B is a front view of a preferred embodiment of a bracket member of strain relief plate assembly in accordance with a preferred embodiment of the present invention.
Figure 3C:
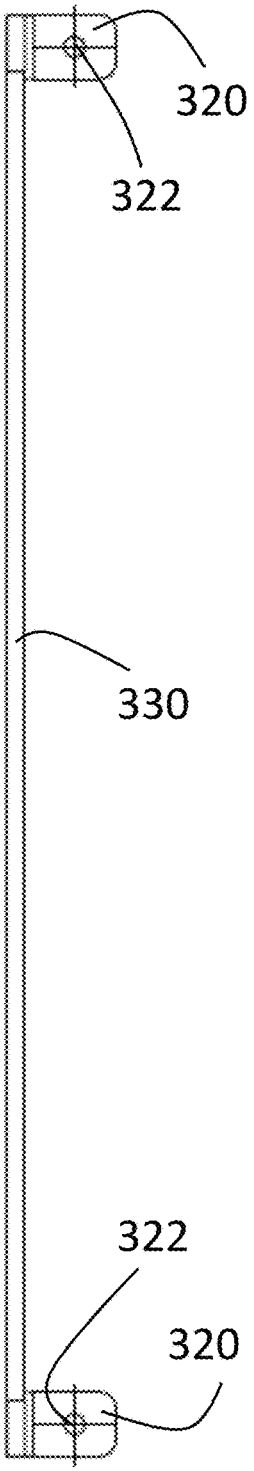
FIG. 3C is a top view of a preferred embodiment of a bracket member of strain relief plate assembly in accordance with a preferred embodiment of the present invention.
Figure 4A:
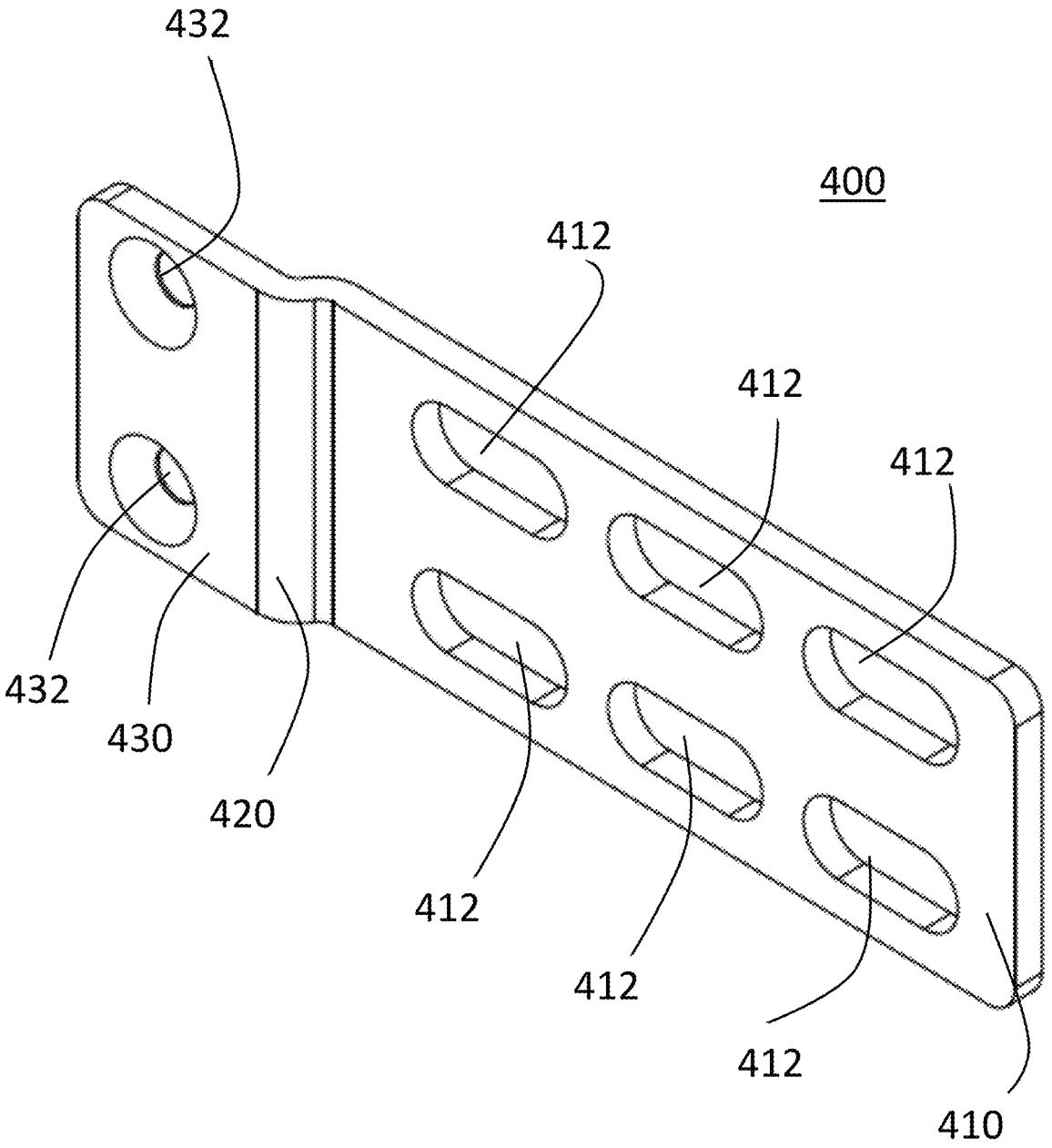
FIG. 4A is a perspective view of a preferred embodiment of a tie down plate of strain relief plate assembly in accordance with a preferred embodiment of the present invention.
Figure 4C:
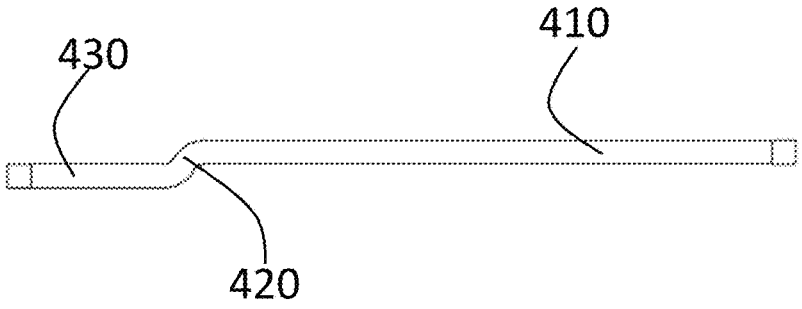
FIG. 4C is a side view of a preferred embodiment of a tie down plate of strain relief plate assembly in accordance with a preferred embodiment of the present invention.
Figure 4B:
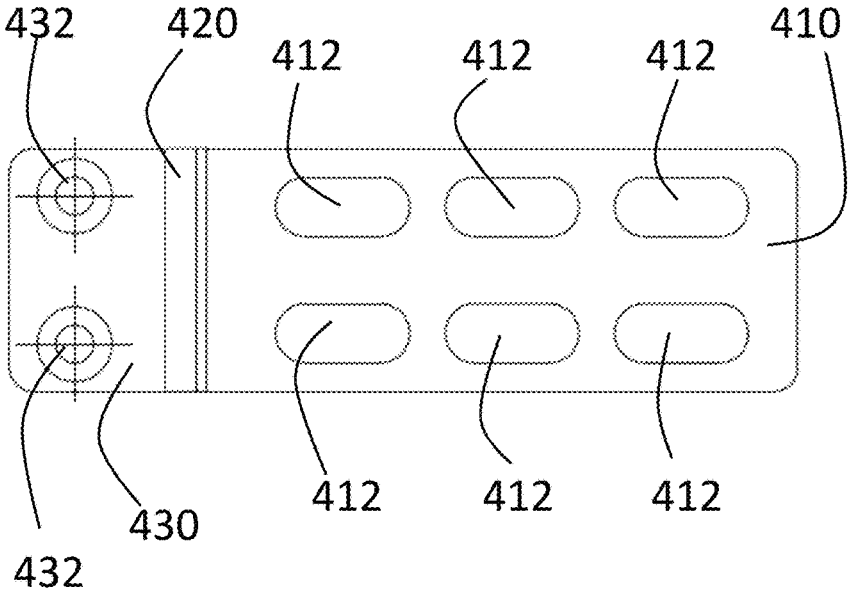
FIG. 4B is a front view of a preferred embodiment of a tie down plate of strain relief plate assembly in accordance with a preferred embodiment of the present invention.
Figure 4D:
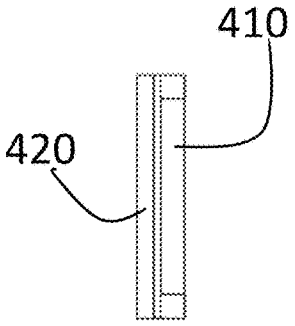
FIG. 4D is a top view of a preferred embodiment of a tie down plate of strain relief plate assembly in accordance with a preferred embodiment of the present invention.

The preferred embodiments of the inventions are described with reference to the drawings. A strain relief plate assembly 200 in accordance with a preferred embodiment of the present invention is shown in FIGS. 2A-2D. The strain relief plate assembly 200 has a bracket member 300 and a plurality of tie down plates 400 removably connected to the bracket member 300. The strain relief plate further has a pair of captive screws 340 or other connectors for connecting the bracket member to an interface module.

The bracket member 300, shown in FIGS. 3A-3D, has a pair of arms 310 and a support member 330 between the two arms 310. As shown in FIGS. 3A-3D, the arms 310 extend from the support member 330. The support member 330 is configured to allow attachment of a plurality of tie down plates. For example, support member 330 may have a plurality of holes 332 for connecting a plurality of tie down plates 400 with screws or other connectors. Further, each arm of the bracket member is configured to connected to an interface module. For example, the bracket member 300 may have on each arm 310 a connector member or flange 320 for connecting the bracket member 300 to an interface module. In a preferred embodiment, each connecting member or flange 320 has a hole 322 for receiving a captive screw 340 that can be used to connect the bracket member 300 to an interface module. Connectors other than captive screws may be used. The spacing of the holes 332 in the support member 330 can be chosen to accommodate various sizes for shapes of tie down plates 400. In the preferred embodiment shown in the figures, the holes are in two groups with the holes in each group evenly spaced to allow a variety of placements of tie down plates 400 on the support member 300. The invention is by no means limited to such spacing of the holes.

The assembly 200 further has one or more tie down plates 400 removably connected to the support member 300, for example, with screws 200 through holes 432 in the tie down plate 400 and holes 332 in the support member 330. While holes and screws are shown in the preferred embodiment for connecting the tie down plates to the support member other connecting means, such as clips, studs, bolts are other means may be used provided that the assembly is configurable so the number, size and/or placement of the tie-down plates may be changes, selected or adjusted. Each tie down plate 400 is configured to allow wires or cables to be connected to the tie down plate. For example, a tie down plate may have one or more holes 412 for connecting wires or contacts to the tie down plate 400, for example, with one or more zip ties or clips 130. In the preferred embodiment, the tie down plate 400 have three sections, a tie-down section 410, a relief section 420 and a connector section 430. The connector section has two holes 432 for receiving screws to connect the tie down plate to the support member 330 of the bracket 300. The holes 432 in the tie down plate are aligned with holes 332 in the support member 330 of the bracket member 300 and screws are placed through holes 432 and into holes 332. The holes 432 in the tie down plate can be align with any pair of holes 332 in the support member 330 of the bracket member 300. In this manner, tie down plates of different sizes and shapes may be used any tie down plate may be removably connected to the bracket member in a variety of different positions. In the preferred embodiment, the tie down holes 412 are shown as slots but are not limited to any particular shape.

Figure 5:
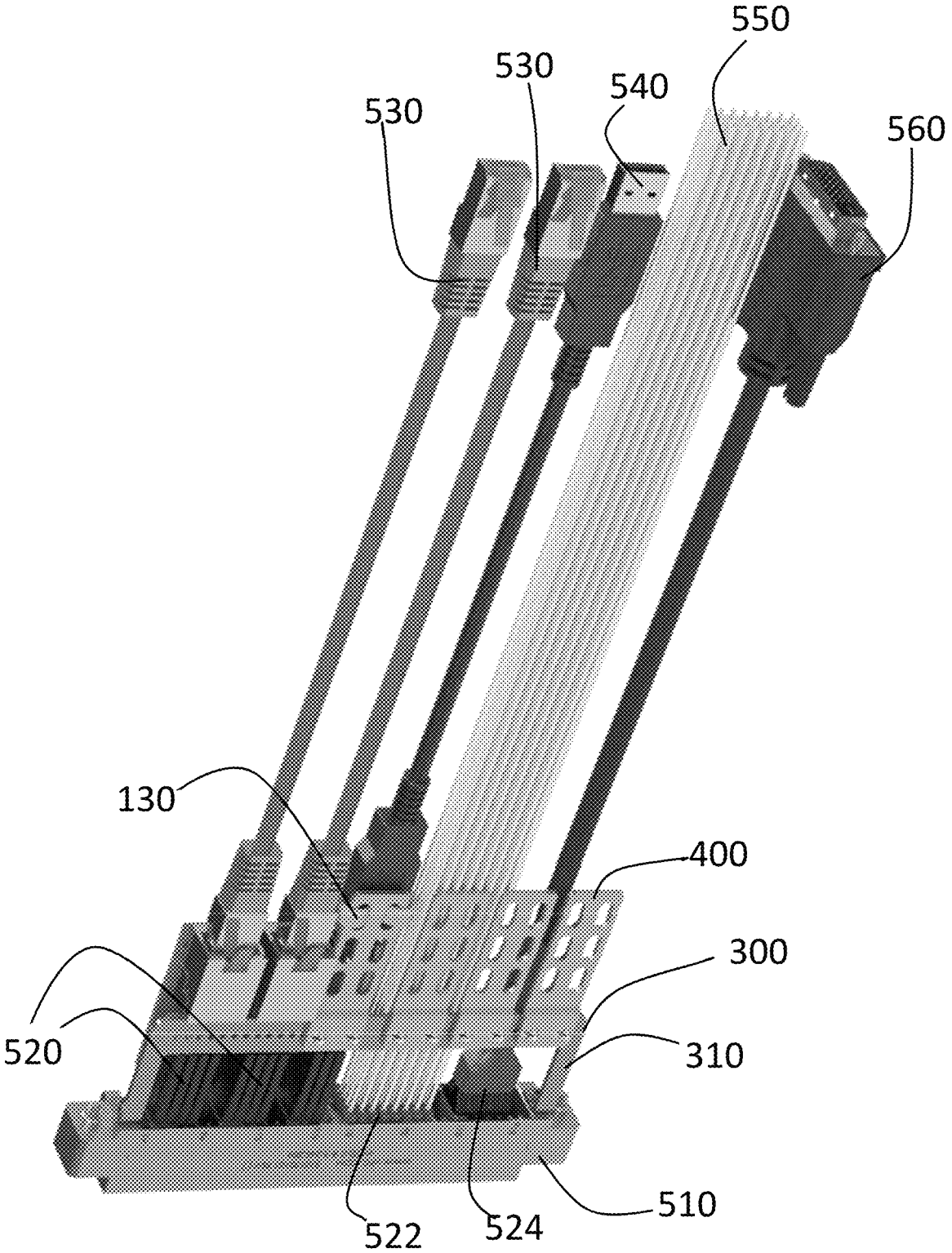
FIG. 5 is a perspective view of a preferred embodiment of a strain relief plate assembly in accordance with a preferred embodiment of the present invention connected to an interface module and a plurality of wires.

As shown in FIG. 5, the strain relief plate assembly 200 is mounted to an interface module 510. A variety of pins and connectors 520 are mounted in the module 510 and have a variety of wires and/or cables 530, 540, 550, 560 (e.g., Ethernet, USB, etc.) attached to them. Straps or ties 130 of any type can be used to secure the wires and/or cables to the tie down plates. In the embodiment shown in FIG. 5, the bracket arms are of a length selected such that the support member additionally functions to support the connectors 520 and hold them into the module. In the example shown in FIG. 4, four tie down plates are shown connected to the support member 300. From this, one can see that a wide variety of arrangements of tie down plates on the support member are possible, thus making the strain relief plate configurable to the user's needs.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A configurable strain relief plate assembly comprising:
a bracket member comprising:
a pair of arms, each said arm having a connector flange at a distal end, each said connector flange having a hole for receiving a screw; and
a support member extending between the two arms, the support member having a plurality of holes for receiving screws, said support member being configured to support a plurality of independent tie down plates simultaneously; and
a captive screw in the hole in each connector flange for connecting the bracket member to an interface module; and
a tie down plates removably connected to the support member, the tie down plate having a first plurality of holes near one end aligned with holes in the support member of the bracket member and a second plurality of holes for receiving connectors for connecting wires or cables to the tie down plate; and
a plurality of screws connecting the tie down plate to the support member of the bracket member.

2. The configurable strain relief plate assembly according to claim 1, wherein the pair of arms and the support member of the bracket member are a unitary structure.

3. The configurable strain relief plate assembly according to claim 1, further comprising a second tie down plate connected to the support member, the second tie down plate having a first plurality of holes near one end aligned with holes in the support member of the bracket member and a second plurality of holes for receiving connectors for connecting wires or cables to the tie down plates.

4. A configurable strain relief plate assembly comprising:
a bracket member comprising:

a support member configured to allow for connection of a plurality of tie down plates to the support member, said support member having a plurality of holes for securing tie down plates to said support member with screws; and a plurality of mounting members extending from said support member, each said mounting member having a distal end portion configured to connect said mounting member to an interface module; and a plurality of tie down plates removably connected to the support member with screws in different ones of said plurality of holes in said support member, each tie down plate having a first end configured to connect to said support member of the bracket member and a second portion configured to receive a plurality of connectors for connecting wires or cables to the tie down plate.

5. The configurable strain relief plate assembly according to claim 4, wherein each of said plurality of mounting members has a flange at a distal end and a hole in said flange for connecting said mounting member to an interface module with a screw.

6. The configurable strain relief plate assembly according to claim 4, wherein each of said plurality of tie down plates is connected to said support member with at least one screw.

7. A configurable strain relief plate assembly comprising:

a bracket member comprising:

a support member configured to allow for connection of a plurality of tie down plates to the support member simultaneously; and a plurality of mounting members extending from said support member, each said mounting member having a distal end portion configured to connect said mounting member to an interface module; and a tie down plate removably connected to the support member, the tie down plate having a first end configured to connect to said support member of the bracket member and a second portion configured to receive a plurality of connectors for connecting wires or cables to the tie down plate.

* * * * *